US011160350B2

(12) United States Patent
Ishida

(10) Patent No.: US 11,160,350 B2
(45) Date of Patent: Nov. 2, 2021

(54) COSMETIC MATERIAL CONTAINER

(71) Applicant: TOKIWA CORPORATION, Nakatsugawa (JP)

(72) Inventor: Yukikazu Ishida, Kawaguchi (JP)

( * ) Notice: Subject to any disclaimer, the term of this patent is extended or adjusted under 35 U.S.C. 154(b) by 0 days.

(21) Appl. No.: 17/102,436

(22) Filed: Nov. 24, 2020

(65) Prior Publication Data

US 2021/0251368 A1 Aug. 19, 2021

(30) Foreign Application Priority Data

Feb. 17, 2020 (JP) ..... JP2020-024636

(51) Int. Cl.
*A45D 40/20* (2006.01)

(52) U.S. Cl.
CPC ..... *A45D 40/205* (2013.01); *A45D 2040/208* (2013.01)

(58) Field of Classification Search
CPC ..... A45D 40/205; A45D 40/20; A45D 40/04; A45D 40/02; A45D 40/222; A45D 2040/205; A45D 2040/207; A45D 2040/208; A45D 2200/051; A45D 2200/10; B65D 83/0005; B65D 83/0011; B65D 83/0022; B65D 83/0027; B65D 83/0033
USPC ..... 401/68, 75, 82, 87, 88, 98; 220/213, 220/254.1, 780, 345.1; 206/823
See application file for complete search history.

(56) References Cited

U.S. PATENT DOCUMENTS 7,455,467 B2 * 11/2008 Sasaki ..... A45D 40/04 401/68
10,045,601 B2 * 8/2018 Endo ..... A45D 40/20

FOREIGN PATENT DOCUMENTS

JP 3169255 7/2011
JP 3174125 3/2012

* cited by examiner

*Primary Examiner* — David J Walczak
(74) *Attorney, Agent, or Firm* — Soei Patent & Law Firm

(57) ABSTRACT

A cosmetic material container includes a container body, a leading cylinder, and a cap forming a hole to receive the leading cylinder. A leading cylinder front portion forms an opening and is tapered toward the opening. A cross section of the leading cylinder front portion forms a flattened shape extending in a first major axis and a first minor axis. A closed-ended closing portion inside the cap covers the opening of the leading cylinder, and has an inner surface to contact the leading cylinder front portion. A cross section of the hole of the cap forms a flattened shape extending in a second major axis and a second minor axis. The hole includes a guide surface so that the first major axis of the leading cylinder front portion coincides with the second major axis of the hole of the cap when the leading cylinder is inserted into the hole.

6 Claims, 15 Drawing Sheets

COSMETIC MATERIAL CONTAINER

CROSS-REFERENCE TO RELATED APPLICATIONS

This application claims the benefit of priority from Japanese Patent Application No. 2020-024636, filed on Feb. 17, 2020, the entire contents of which are incorporated herein by reference.

BACKGROUND

In the related art, various cosmetic material containers are known. Japanese Utility Model Registration No. 3169255 discloses a feeding container for a volatile stick-shaped cosmetic material, including a cylindrical leading cylinder having two open ends, a container body which engages with the leading cylinder to be immovable (or fixed) in an axial direction, and an airtight cap detachably mounted on a leading cylinder front portion. A volatile stick-shaped cosmetic material is contained in the leading cylinder, and the cap includes therein, an intermediate lid mounted to cover a leading end of the leading cylinder and to be in close contact with the leading end. A cross-section of the cap taken along a plane orthogonal to the axial direction has a circular shape. In addition, a cross section of the leading cylinder taken along a plane orthogonal to the axial direction has a circular shape.

Japanese Utility Model Registration No. 3174125 discloses a stick-shaped cosmetic material feeding container and a cosmetic. The stick-shaped cosmetic material feeding container includes a leading cylinder, a container body engaging with the leading cylinder in the axial direction, and a cap mounted on a leading cylinder front portion. The cap is mounted on the leading cylinder front portion, thereby sealing the cosmetic material contained in the leading cylinder. A cross-section of the cap taken along a plane orthogonal to the axial direction has a circular shape. A cross section of the leading cylinder taken along a plane orthogonal to the axial direction has a circular shape.

SUMMARY

In the volatile stick-shaped cosmetic material feeding container and the stick-shaped cosmetic material feeding container described above, the cap seals the leading cylinder, thereby suppressing volatilization of the cosmetic material contained in the leading cylinder. The cross section of the leading cylinder when the leading cylinder is taken along the plane orthogonal to the axial direction has the circular shape. In some cases of a cosmetic material container, the cross section of the leading cylinder and the cosmetic material may have a flattened shape so that a thin line or a thick line can be selectively drawn using the cosmetic material.

In a case where each cross section of the leading cylinder and the cosmetic material has the flattened shape, the leading cylinder may be rotated with respect to an application target surface, to selectively draw the thin line or the thick line on the application target surface. Accordingly, ease of use can be improved. However, the cap has a circular cross-sectional shape and forms a circular opening, and therefore a gap may be formed between an outer surface of the flattened leading cylinder and an inner surface of the circular opening of the cap. Consequently, an airtightness of the cosmetic material contained inside the leading cylinder having the flattened shape may be compromised.

Examples described herein aim to improve an airtightness for a cosmetic material contained in a cosmetic material container that includes a leading cylinder having a flattened shape.

According to an example, there is provided a cosmetic material container extending in an axial direction and including a leading cylinder having a leading cylinder front portion having an opening through which a cosmetic material appears, a container body extending rearwardly in the axial direction from the leading cylinder, and a cap having a cylinder hole for an insertion of the leading cylinder. The cap includes therein a closed-ended closing portion (e.g., a bottomed cylindrical closing portion) that closes the opening of the leading cylinder. A cross section of the leading cylinder front portion taken along a plane orthogonal to the axial direction has a flattened shape having a first major axis and a first minor axis. The leading cylinder front portion has a tapered surface in which a width of the first major axis decreases toward the opening. A cross section of the cylinder hole of the cap, taken along the plane orthogonal to the axial direction has a flattened shape having a second major axis and a second minor axis. The cylinder hole includes a guide surface to rotationally guide the leading cylinder relative to the cap, so that an extending direction of the first major axis associated with the leading cylinder coincides (or aligns) with an extending direction of the second major axis associated with the cap, when the leading cylinder front portion is inserted into the cylinder hole of the cap. The leading cylinder front portion is in close contact with an inner surface of the closing portion.

In the example cosmetic material container, the leading cylinder includes the leading cylinder front portion having the opening through which the cosmetic material appears. The cross section of the leading cylinder front portion taken along the plane orthogonal to the axial direction has the flattened shape having the first major axis and the first minor axis. Consequently, the cosmetic material exposed from the opening may be applied to an application target surface, and the leading cylinder may be rotated to selectively draw a thin line or a thick line, so as to improve ease of use of the cosmetic material container. The cap of the cosmetic material container includes therein the closed-ended closing portion that closes or covers the opening of the leading cylinder. Accordingly, the opening in the leading end can be closed or covered by the closed-ended closing portion, so as to achieve the airtightness for the cosmetic material contained inside the leading cylinder. The leading cylinder front portion has the tapered surface in which the width of the first major axis decreases toward the opening. The leading cylinder front portion is in close contact with the inner surface of the closing portion of the cap, so as to further improve the airtightness for the cosmetic material contained inside the leading cylinder. Furthermore, the cap includes the cylinder hole having a cross section that has the flattened shape defining the second major axis and the second minor axis. The cylinder hole includes the guide surface for guiding the rotation of the leading cylinder relative to the cap so that the extending direction of the first major axis of the leading cylinder front portion associated with the leading cylinder coincides or aligns with the extending direction of the second major axis associated with the cap, when the leading cylinder front portion is inserted into the cap. Accordingly, for any rotational position of the leading cylinder having the flattened shape, with respect to the cap having the flattened shape, when the leading cylinder front portion is inserted into the cap, the guide surface guides the leading cylinder into rotation so that the first major axis coincides with the second major axis. Accordingly, the cap can be more easily mounted on the leading cylinder. For example, for any rotational position of the leading cylinder having the flattened shape, with respect to the cap having the flattened shape, the rotational position of the leading cylinder may be corrected by the guide surface, when the leading cylinder is inserted into the cap. Accordingly, the cap can be more easily mounted on to the leading cylinder having the flattened shape.

The leading cylinder may have a leading cylinder rear portion located between the leading cylinder front portion and the container body. An outer surface of the leading cylinder rear portion may include a contact surface to contact the guide surface of the cylinder hole of the cap. A rotation of the leading cylinder with respect to the cap may be restricted in a state where the contact surface of the leading cylinder rear portion is in contact with the guide surface of the cylinder hole. In this case, when the leading cylinder rear portion enters the cylinder hole of the cap, the contact surface of the leading cylinder rear portion comes into contact with the guide surface of the cylinder hole. Accordingly, the rotation of the leading cylinder with respect to the cap is restricted. Consequently, the leading cylinder rear portion can enter the cylinder hole along the axial direction without being rotated, to mount the cap more smoothly on the leading cylinder.

The leading cylinder front portion may have a leading end portion in which the width of the first major axis is equal to or narrower than the width of the second minor axis of the cylinder hole. In this case, the width of the first major axis in the leading end portion is equal to or narrower than the width of the second minor axis of the cylinder hole. Accordingly, the leading end portion can be more easily inserted into the cylinder hole. For example, for any rotational position of the leading end portion of the leading cylinder with respect to the cap, the leading end portion can be inserted into the cylinder hole. Accordingly, the cap can be more easily mounted on the leading cylinder.

The cross section of the leading cylinder front portion taken along the plane orthogonal to the axial direction may have an elliptical shape. In this case, the shape of the leading cylinder front portion can have a smooth shape without any corner portion or without forming any angles. Accordingly, the leading cylinder front portion can be more smoothly rotated along the guide surface. Consequently, the cap can be more easily mounted on the leading cylinder.

A cross section of the cylinder hole of the cap including a flattened surface (or substantially planar surface) as the guide surface, taken along the plane orthogonal to the axial direction, may have a substantially oblong shape. Additionally, a cross section of the leading cylinder rear portion including a flattened surface (or substantially planar surface) as the contact surface, taken along the plane orthogonal to the axial direction, may have a substantially oblong shape. Accordingly, the rotation of the leading cylinder is restricted in a state in which the flattened contact surface of the leading cylinder rear portion is in contact with the flattened guide surface of the cylinder hole, so that the leading cylinder rear portion can be more smoothly inserted into the cylinder hole.

The cross section of the cap including a cap flattened surface, taken along the plane orthogonal to the axial direction may have a substantially oblong shape. Additionally, the cross section of the container body including a container body flattened surface, taken along the plane orthogonal to the axial direction may have a substantially oblong shape. The cap flattened surface may be continuous with the container body flattened surface along the axial direction. In this manner, a user can more easily recognize a rotational position of the cap with respect to the container body. For example, the user can recognize that the cap may be mounted so that the cap flattened surface is aligned with the container body flattened surface, so as to more easily mount the cap on the container body, and further improve the ease of use of the cosmetic material container.

The cosmetic material container according to the examples described herein are configured to improve airtightness for the cosmetic material contained inside the leading cylinder having the flattened shape.

DETAILED DESCRIPTION

Hereinafter, examples of a cosmetic material container will be described with reference to the drawings. In the following description, with reference to the drawings, the same reference numbers are assigned to the same components or to similar components having the same function, and overlapping description is omitted.

Figure 1:
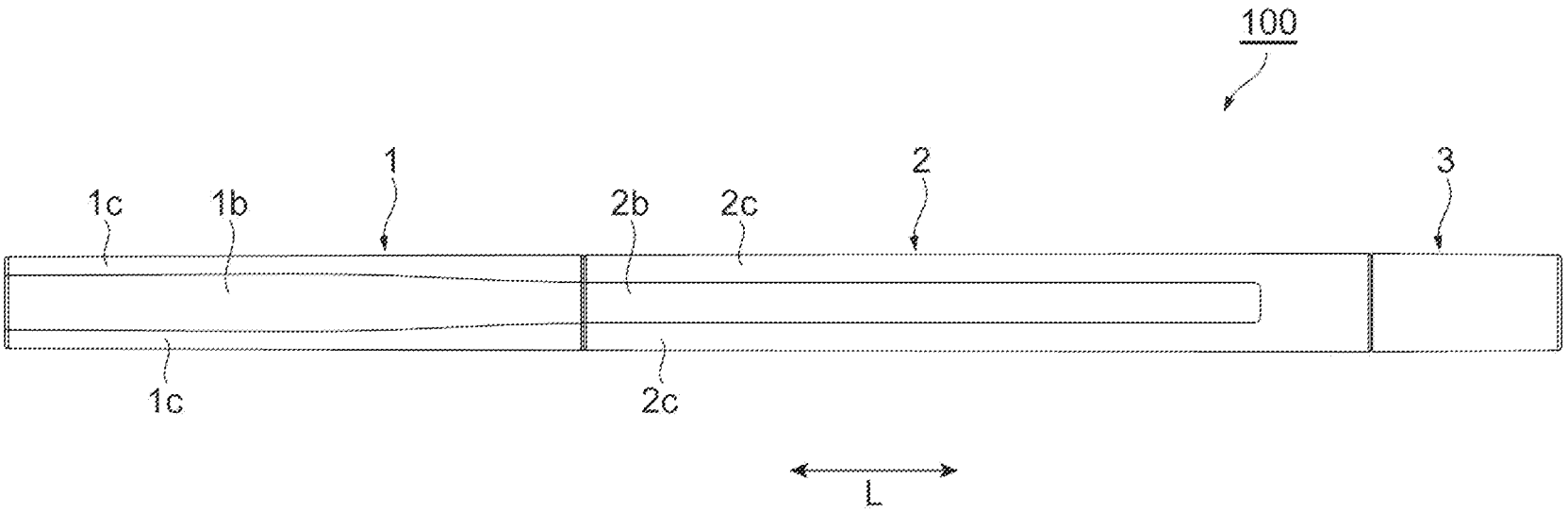
FIG. 1 is a side view of a cosmetic material container according to an example.

FIG. 1 is a side view illustrating an example cosmetic material container 100 having a stick shape and extending along an axial direction L. The cosmetic material container 100 includes a cap 1, a container body 2, and an operation cylinder 3, as an external configuration. For example, the cosmetic material container 100 may be a pencil that feeds (e.g., by pushing out) a cosmetic material M (cf. FIG. 3) contained therein by operating the operation cylinder 3.

In the present disclosure, the "axial direction" represents an extending direction of an axis in which the axis of a leading cylinder (to be described later) of the cosmetic material container extends, and for example, the "axial direction" coincides with a longitudinal direction of the cosmetic material container. In addition, a direction from the container body 2 toward the cap 1 will be referred to as a "forward" direction, and a direction from the container body 2 toward the operation cylinder 3 will be referred to as a "rearward" direction, in the present description. In addition, an orientation in the forward direction or a relative position that is toward the forward direction may be referred to herein as a "front", "front side", "front end" or the like, and an orientation in the rearward direction or a relative position that is toward the rearward direction may be referred to herein as a "rear", "rear side", "rear end", "behind" or the like. The directions are set for convenience of description and ease of understanding, and the directions are not particularly limited.

Figure 14:
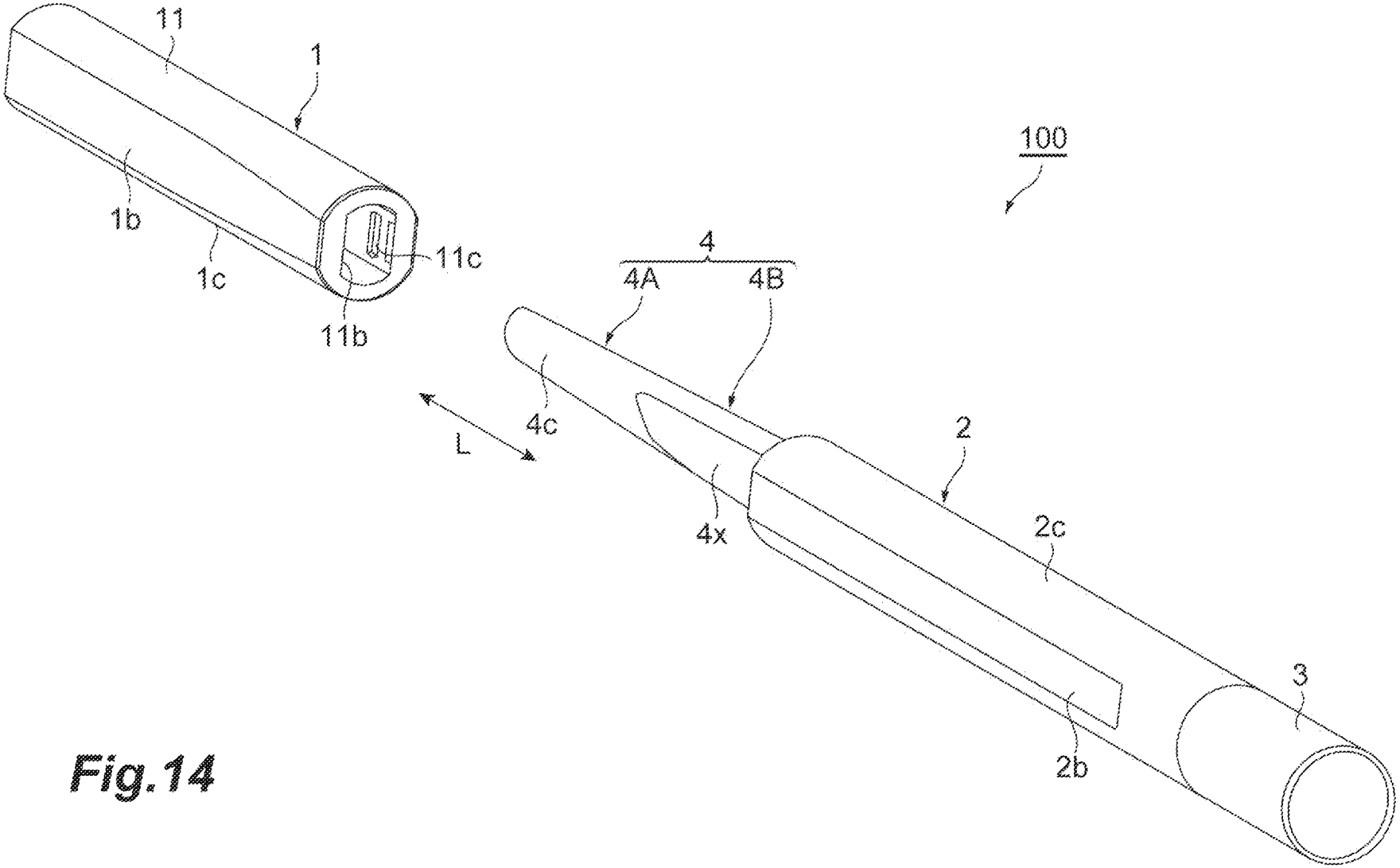
FIG. 14 is a perspective view of the cosmetic material container of FIG. 1, illustrating a state in which the cap is removed and the leading cylinder is exposed.

Still with reference to FIG. 1, and with further reference to FIG. 14, the cap 1 has a cap flattened surface 1*b*, and the container body 2 has a container body flattened surface 2*b*. The cap 1 is mounted on the container body 2 so that the cap flattened surface 1*b* is continuous (or aligned) with the container body flattened surface 2*b* along the axial direction L. In the present disclosure, the "cap flattened surface" indicates a substantially planar surface formed on an outer periphery of the cap, and the "container body flattened surface" indicates a substantially planar surface formed on an outer periphery of the container body. In the present disclosure, the "flattened surface" includes not only a strictly planar surface but also a curved surface having a slightly convex shape, or a slightly concave shape.

For example, a portion of the surface of the cap 1, other than the cap flattened surface 1*b*, is a curved surface 1*c* that extends along a substantially circumferential direction of the cap 1. The circumference direction extends about a longitudinal axis of the cap 1, for example, along a plane that is orthogonal to the axial direction L. For example, the cap flattened surface 1*b* may linearly extend along the axial direction L, and a width of the cap flattened surface 1*b* may increase toward a front side (away from the container body 2), for an improved grip. For example, the cap 1 can be more easily picked with a finger. Accordingly, the cosmetic material container 100 can improve the ease of use.

A portion of the surface of the container body 2, other than the container body flattened surface 2*b*, is a curved surface 2*c* that extends along a substantially circumferential direction of the container body 2. The circumference direction extends about a longitudinal axis of the container body 2, for example, along a plane that is orthogonal to the axial direction L. For example, the container body flattened surface 2*b* linearly extends along the axial direction L, and extends to an intermediate portion of the container body 2 in the axial direction L. Namely, the container body flattened surface 2*b* does not extend to a rear side or rear end (an end adjacent the operation cylinder 3) of the container body 2, and a cross section of the container body 2 taken at the rear end portion of the container body 2 along a plane orthogonal to the axial direction L, has a circular shape.

The operation cylinder 3 functions as a tail plug of the cosmetic material container 100. For example, the operation cylinder 3 closes a rear end of the cylindrical container body 2 by engaging with the container body 2. For example, the operation cylinder 3 has a substantially bottomed (closed-ended) cylindrical shape. Therefore, a cross section of the operation cylinder 3 taken along the plane orthogonal to the axial direction L has a circular shape. Accordingly, both the cross section of the rear end portion of the above-described container body 2 and the cross section of the operation cylinder 3 have circular shapes, so that the container body 2 and the operation cylinder 3 can be smoothly continuous with each other.

Figure 2:
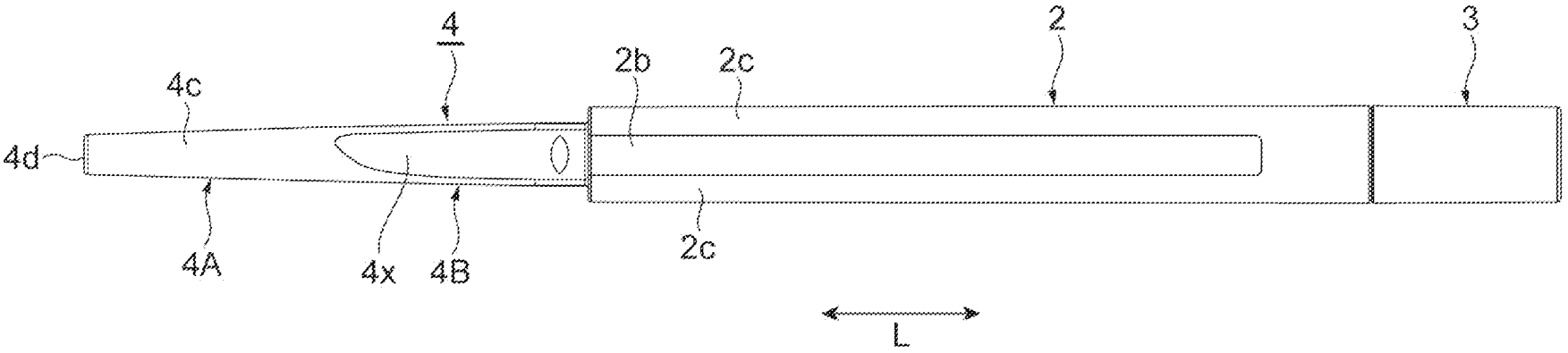
FIG. 2 is a side view of the example cosmetic material container of FIG. 1, illustrating a state where a cap of the cosmetic material container is removed.

FIG. 2 is a side view illustrating a state where the cap 1 is removed from the cosmetic material container 100. With reference to FIGS. 1 and 2, for example, the cap 1 is mounted on a leading cylinder 4. The leading cylinder 4 engaging with the container body 2 in the axial direction L is contained inside the cap 1. The leading cylinder 4 includes a leading cylinder front portion 4A having a flattened shape, and a leading cylinder rear portion 4B having a flattened surface (or substantially planar surface) 4*x*. In the present disclosure, the "flattened shape" indicates a cross-sectional shape having a first dimension (e.g., a first width) in a major axis and a second dimension (e.g., a second width) in a minor axis that is shorter than the first dimension, in a cross-section taken along a plane that is orthogonal to the longitudinal direction. Depending on examples, the flattened shape may have an outline that is curved, an outline that includes linear segments, an outline that includes curved segments, or an outline that includes both at least one curved segment and at least one linear segment. In some examples, the leading cylinder 4 is formed of a low-friction material (e.g., a slippery material), such as polybutylene terephthalate (PBT), as an example.

Figure 3:
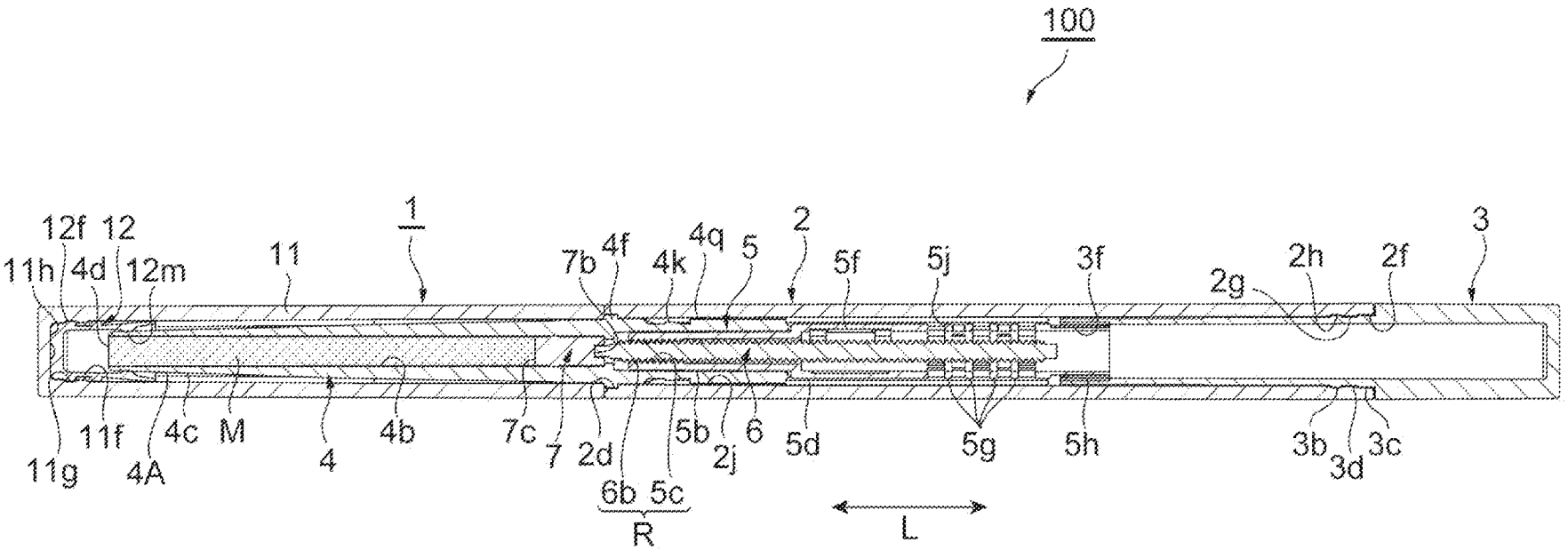
FIG. 3 is a longitudinal sectional view of the example cosmetic material container illustrated in FIG. 1.

FIG. 3 is a longitudinal sectional view of the cosmetic material container 100 of FIG. 1. As illustrated in FIG. 3, the cap 1 includes an outer cap 11 exposed outwardly of the cosmetic material container 100, and a closing portion 12 functioning as an inner cap that is separate from the outer cap 11 and located inside the outer cap 11. For example, the closing portion 12 closes or covers an opening 4*d* of the leading cylinder 4 in a state where the leading cylinder front portion 4A of the leading cylinder 4 is inserted into the closing portion 12.

The outer cap 11 is formed of a low-friction material (e.g., a slippery material), such as an acrylonitrile butadiene styrene (ABS) resin, for example. In some examples, the closing portion 12 is formed of an elastic material, such as polyester thermoplastic elastomer (TPEE), for example.

The container body 2 includes therein a cylindrical female screw member 5 that is rotationally engaged with the operation cylinder 3. The cylindrical female screw member 5 includes therein a female screw 5*c*. The container body 2 includes therein a moving body 6 having a male screw 6*b* screwed into the female screw 5*c* of the female screw member 5, and a piston 7 interposed between the moving body 6 and the cosmetic material M to displace the cosmetic material M forward in response to a forward movement of the moving body 6. For example, the female screw 5*c* and the male screw 6*b* form a screwing portion R of the cosmetic material container 100, and the moving body 6 moves forward by a screwing operation of the screwing portion R.

In some examples, the female screw member 5 is formed of polyacetal (POM). The female screw member 5 includes a front side cylinder portion 5*b* having the female screw 5*c*, a large-diameter cylinder portion 5*d* on the rear side of the front side cylinder portion 5*b*, and a spring portion 5*j* located on a rear side of the large-diameter cylinder portion 5*d*, opposite to the front side cylinder portion 5*b*. The large-diameter cylinder portion 5*d* has a diameter that is greater than a diameter of the front side cylinder portion 5*b*. The front side cylinder portion 5*b* serves as an insertion portion inserted into the leading cylinder 4 from the rear. For example, the female screw 5*c* is formed on a front side or front end portion (e.g., a portion including a front end) of the front side cylinder portion 5*b*.

According to examples, the large-diameter cylinder portion 5*d* has an elastic protruding portion 5*f* which is elastic in a radial direction of the female screw member 5. The elastic protruding portion 5*f* is divided by a pair of slits extending in the circumferential direction of the female screw member 5 and aligned in the axial direction, and a slit extending in the axial direction between ends of the pair of slits.

For example, the slits form a U-shape, and the elastic protruding portion 5*f* are disposed inside the U-shaped slits. For example, the elastic protruding portion 5*f* click-engages (forming a click-connector) with a protruding portion formed on an inner surface of the container body 2. The click engagement in the present disclosure indicates a coupling which provides a user with a click feeling while an operation of the user generates click sound of "tick-tick" through engagement and disengagement in engagement between the elastic protruding portion 5*f* and the protruding portion formed on the inner surface of the container body 2, for example.

For example, the spring portion 5*j* configures a resin spring which is expandable and contractible in the axial direction. For example, the spring portion 5*j* is formed by a plurality of slits 5*g* aligned in the axial direction L. A plurality of annular portions other than the slits 5*g* of the spring portion 5*j* are movable in the axial direction. In this manner, the spring portion 5*j* contracts in the axial direction L of the cosmetic material container 100 to absorb a shock. Accordingly, it is possible to improve shock resistance of the cosmetic material container 100.

The female screw member 5 further includes a plurality of ridges 5*h* projecting outwardly in the radial direction of the female screw member 5 on the rear side (or rear end portion) of the spring portion 5*j*. The plurality of ridges 5*h* extend in the axial direction L, and are inserted inside of the operation cylinder 3. Each of the ridges 5*h* engages with a corresponding one of a plurality of engagement projections 3*f* arranged on an inner surface of the operation cylinder 3 in the circumferential direction. Accordingly, the female screw member 5 engages with the operation cylinder 3 to be rotationally fixed relative to each other.

A front side portion of the operation cylinder 3 is inserted into the container body 2 from the rear. The operation cylinder 3 includes an annular projection portion 3*b*, an annular recess portion 3*d*, and an annular projection portion 3*c* formed on an insertion portion of the operation cylinder 3 which is inserted into the rear end of the container body 2 and which is located on a front side relative to an exposed portion of the operation cylinder 3 that forms an outer surface of the cosmetic material container 100. The inner surface at a rear end portion of the container body 2 has an annular recess portion 2*f*, an annular projection portion 2*g*, and an annular recess portion 2*h* with which the operation cylinder 3 engages. The annular projection portion 3*c*, the annular recess portion 3*d*, and the annular projection portion 3*b* engage with the annular recess portion 2*f*, the annular projection portion 2*g*, and the annular recess portion 2*h*, respectively. In this manner, the operation cylinder 3 engages with the container body 2 to be rotatable relative to the container body 2.

The piston 7 is disposed on a front side of the moving body 6. The piston 7 has a recess portion 7*b* in which a front end of the moving body 6 may be inserted, and a pushing surface 7*c* which pushes the cosmetic material M. The pushing surface 7*c* is disposed in a front end of the piston 7, and has a flattened shape, for example. The piston 7 has a function of pushing the cosmetic material M in response to the forward movement of the moving body 6.

In the cosmetic material container 100 described above, when the cap 1 is removed from the leading cylinder 4 and the operation cylinder 3 is rotated relative to the container body 2, the female screw member 5 together with the operation cylinder 3 are rotated relative to the container body 2 and the moving body 6. In this manner, the female screw member 5 is rotated relative to the moving body 6. Accordingly, a screwing operation of the screwing portion R works, and the moving body 6 moves forward by the screwing operation. When the moving body 6 moves forward, the cosmetic material M is pushed forward via the piston 7, so as to expose the cosmetic material M from the opening 4*d* of the leading cylinder 4 so that the cosmetic material M may be applied.

In the above-described example, the container body 2, the operation cylinder 3, the female screw member 5, the moving body 6, and the piston 7 function as a feeding mechanism for the cosmetic material M. However, a configuration of the feeding mechanism of the cosmetic material container is not limited to those which include the container body 2, the operation cylinder 3, the female screw member 5, the moving body 6, and the piston 7, and can be suitably changed. Furthermore, the cosmetic material container according to the present disclosure may be a container that does not include the feeding mechanism for feeding the cosmetic material.

Figure 4:
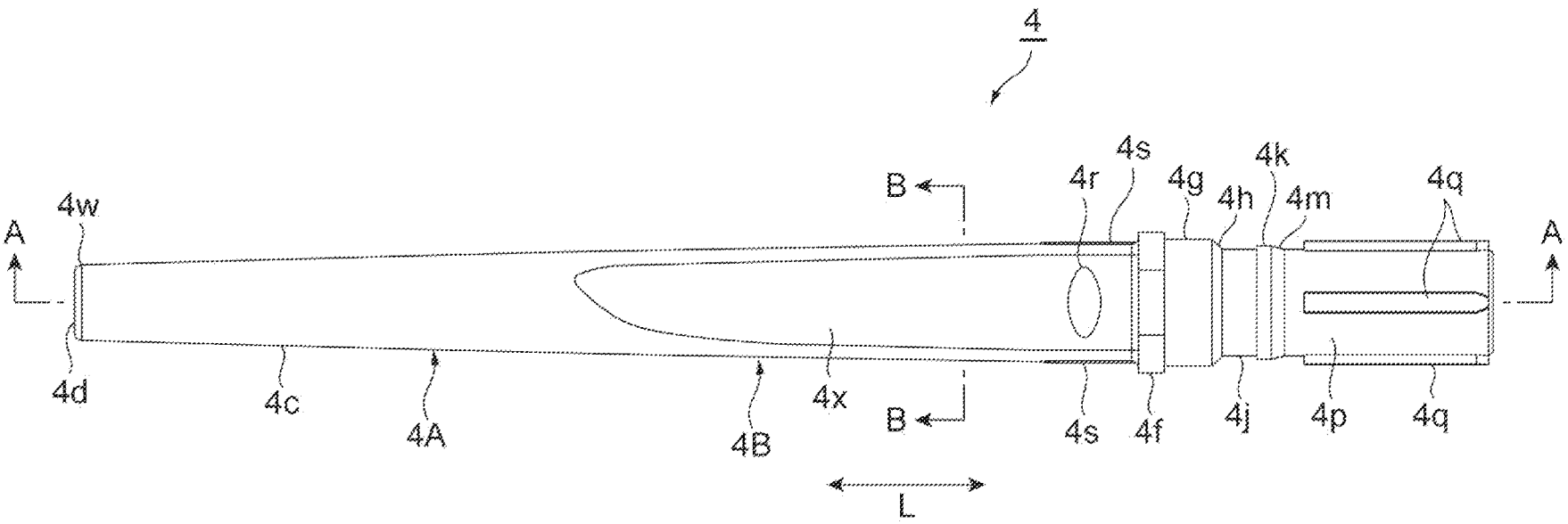
FIG. 4 is a side view of an example leading cylinder of the cosmetic material container of FIG. 1.
Figure 5:
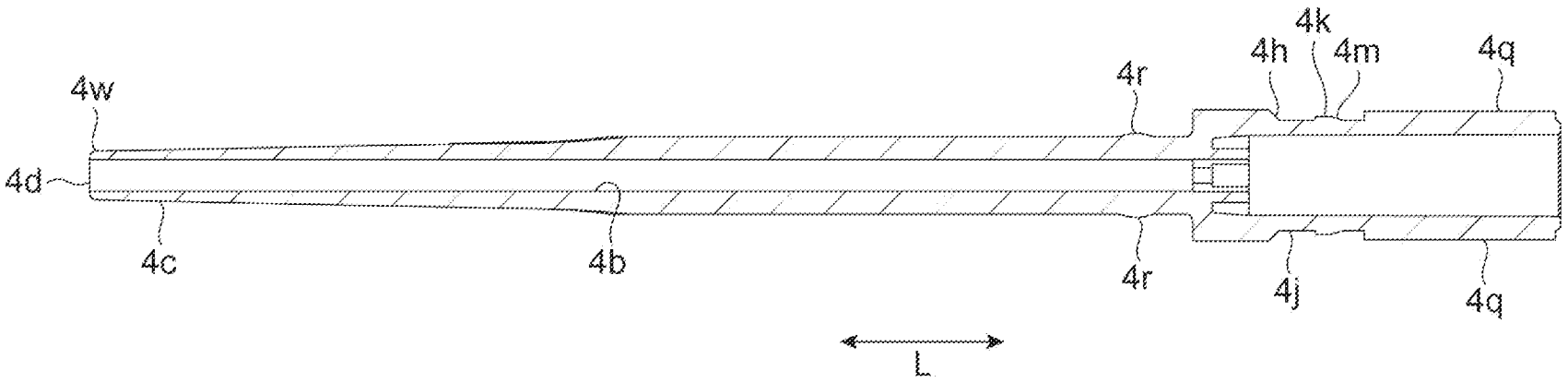
FIG. 5 is a sectional view of the leading cylinder illustrated in FIG. 4, taken along line A-A.

With reference to FIG. 4, the leading cylinder 4 and the cap 1 of the cosmetic material container 100 will be described. FIG. 4 is a side view illustrating the leading cylinder 4. FIG. 5 is a sectional view taken along line A-A in FIG. 4. As illustrated in FIGS. 3, 4, and 5, the leading cylinder 4 has a substantially stepped cylindrical shape extending in the axial direction L. The leading cylinder 4 has a containing area 4*b* for containing the cosmetic material M. The leading cylinder 4 includes a leading cylinder front portion 4A and a leading cylinder rear portion 4B.

The leading cylinder front portion 4A has a leading end portion 4*w* which is a region including the front end and the opening 4*d* of the leading cylinder 4, and a tapered surface 4*c* extending rearwardly from the leading end portion 4*w*. The tapered surface 4*c* is inclined with respect to the axial direction L so that a width in the major axis direction (which may be referred to herein as a diameter) of the leading cylinder 4 gradually increases rearwardly from the leading end portion 4*w*. The leading cylinder rear portion 4B has the flattened surface 4*x* and engagement projections 4*r* and 4*s* with which the cap 1 engages.

According to examples, the leading cylinder rear portion 4B has a pair of the flattened surfaces 4*x* aligned along the width direction of the leading cylinder 4. The flattened surface 4*x* has a strip shape extending longitudinally toward the opening 4*d* from a flange portion 4*f*. For example, a width of the flattened surface 4*x* may decrease in the forward direction away from the flange portion 4*f*. For example, a front end of the flattened surface 4*x* is shaped to form an asymmetric taper.

In this way, the front end of the flattened surface 4*x* may taper asymmetrically. In other examples, the front portion may form a symmetric taper. According to examples, the engagement projection 4*r* is disposed on the flattened surface 4*x*. In a lateral plan view of the leading cylinder 4, the engagement projection 4*r* may have an oblong shape (e.g., elliptical shape) extending lengthwise in a width direction of the leading cylinder 4. The engagement projection 4*s* may extend linearly in the axial direction L.

In the present disclosure, the "oblong shape" indicates a shape having a first dimension (e.g., a first width) taken along a major axis and a second dimension (e.g., a second width) taken along a minor axis that is shorter than the first dimension, and may refer to an elliptical shape or a rounded rectangular shape, for example. The "oblong shape" may have an outline that includes a linear portion. For example, the oblong shape may form a racetrack shape defined by a pair of straight lines extending in the horizontal direction and aligned in the vertical direction, and by a pair of curved lines connecting ends of the pair of straight lines to each other.

The flange portion 4*f*, a cylindrical portion 4*g*, an inclined surface 4*h* inclined so that the diameter of the leading cylinder 4 decreases rearwardly, and an annular recess portion 4*j* located behind the inclined surface 4*h* are disposed behind the leading cylinder rear portion 4B of the leading cylinder 4. An annular projection portion 4*k*, an inclined surface 4*m* inclined so that the diameter of the leading cylinder 4 decreases rearwardly, and a plurality of ridges 4*q* extending in the axial direction L behind the inclined surface 4*m* are disposed further behind the annular recess portion 4*j*.

According to examples, a plurality of ridges 2*j* are formed on the inner surface of the container body 2, and the plurality of ridges 2*j* are arranged along an inner circumferential direction of the container body 2. The ridge 4*q* of the leading cylinder 4 engages with the ridge 2*j* in the rotation direction. In this manner, the leading cylinder 4 engages with the container body 2 to be rotatably fixed with each other. The inclined surface 4*m*, the annular projection portion 4*k*, the annular recess portion 4*j*, the inclined surface 4*h*, and the cylindrical portion 4*g* may be inserted into the container body 2 in this order from the front. The annular projection portion 4*k* engages with the inner surface of the container body 2 in the axial direction. The flange portion 4*f* of the leading cylinder 4 may be inserted into the annular recess portion 2*d* in the front end of the container body 2. According to the above-described configuration, the leading cylinder 4 engages rotatably with the container body 2 and to be fixed (immovable) in the axial direction.

Figure 6:
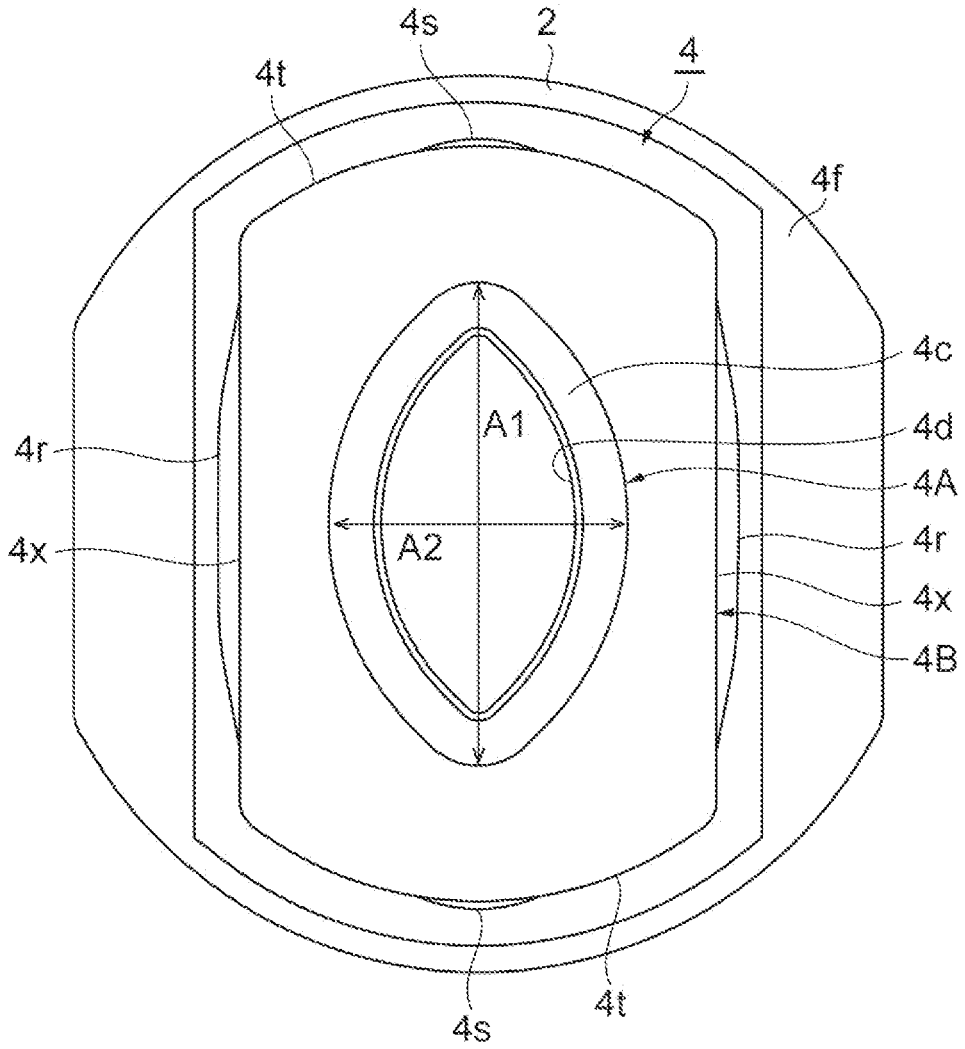
FIG. 6 is a front side view of the leading cylinder illustrated in FIG. 4.
Figure 7:
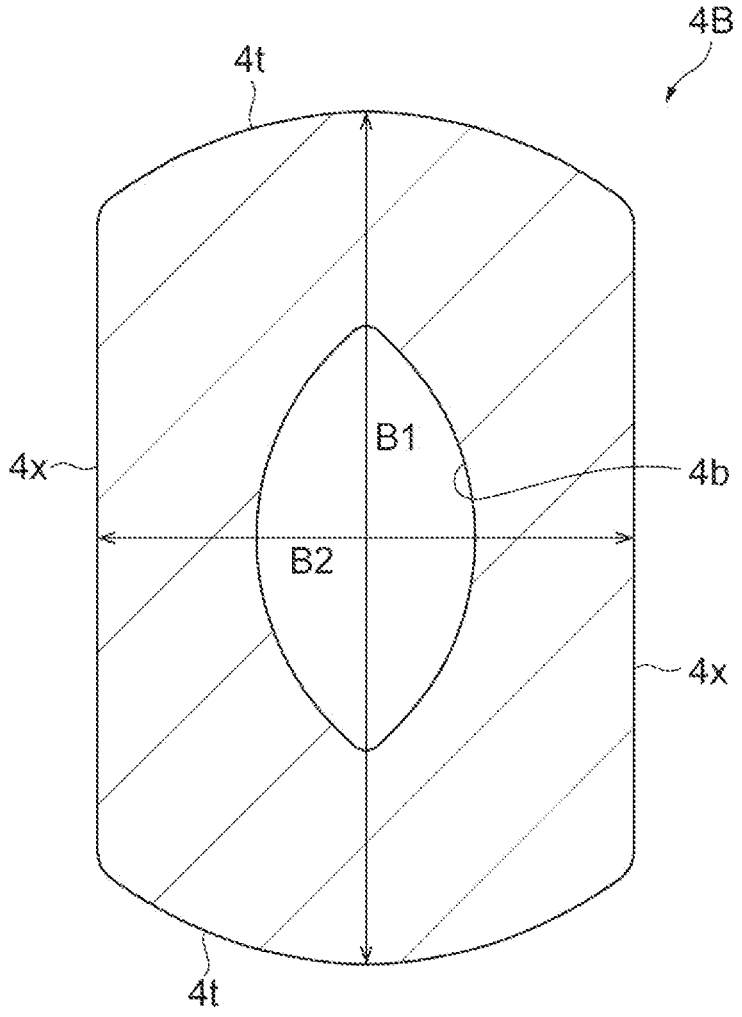
FIG. 7 is a sectional view of the leading cylinder illustrated in FIG. 4, taken along line B-B.

FIG. 6 is a front view when the leading cylinder 4 and the container body 2 are viewed from the front side. FIG. 7 is a sectional view of the leading cylinder rear portion 4B taken along line B-B in FIG. 4. As illustrated in FIGS. 3, 6, and 7, a cross section of the leading cylinder front portion 4A taken along a plane orthogonal to the axial direction L has a flattened shape that extends along a major axis A1 (first major axis) and a minor axis A2 (first minor axis). As an example, the cross section forms an elliptical shape. Similarly, a shape of the leading cylinder front portion 4A of the leading cylinder 4 when viewed from the front side is a flattened shape having the major axis A1 and the minor axis A2. As a result, a shape of the opening 4*d* also has a flattened shape.

A cross section of the leading cylinder rear portion 4B taken along the plane orthogonal to the axial direction L has an oblong shape that extends along a major axis B1 and a minor axis B2 and that includes the pair of flattened surfaces 4*x*. An outer shape of the leading cylinder rear portion 4B when the leading cylinder rear portion 4B is viewed from the front side is also the oblong shape, for example. The pair of flattened surfaces 4*x* are connected to each other by an arcuate curved surface 4*t*, for example.

Figure 8:
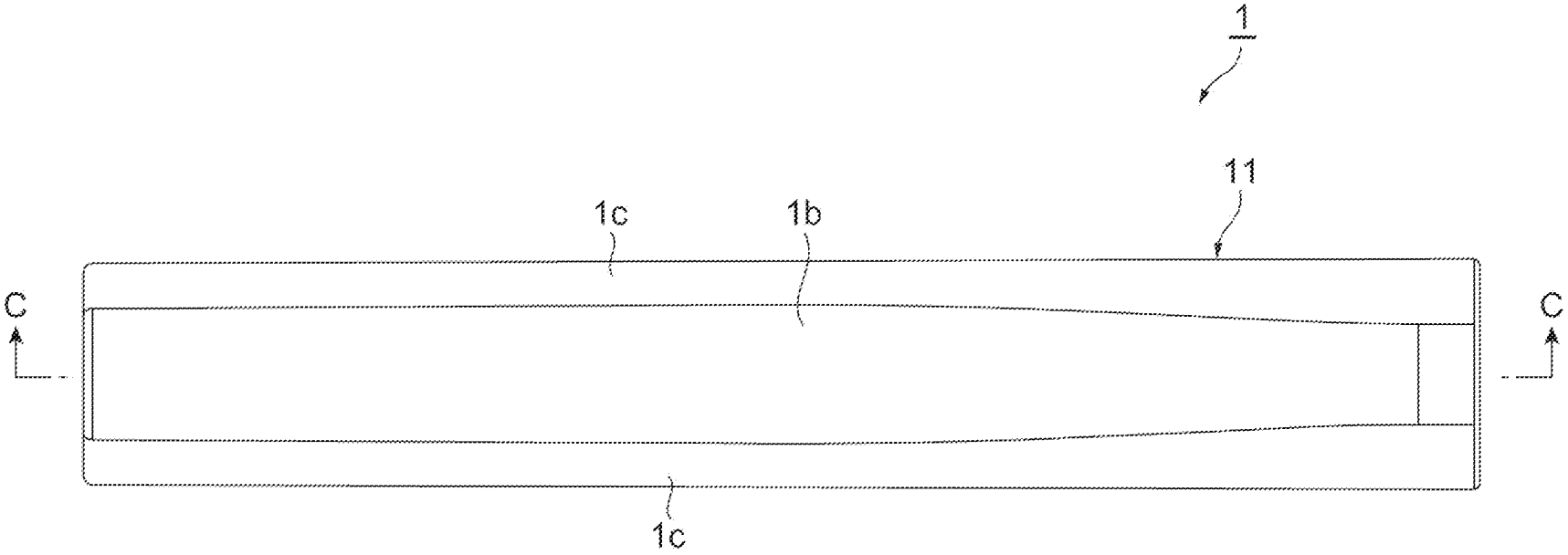
FIG. 8 is a side view of the cap of the cosmetic material container illustrated in FIG. 1.
Figure 9:
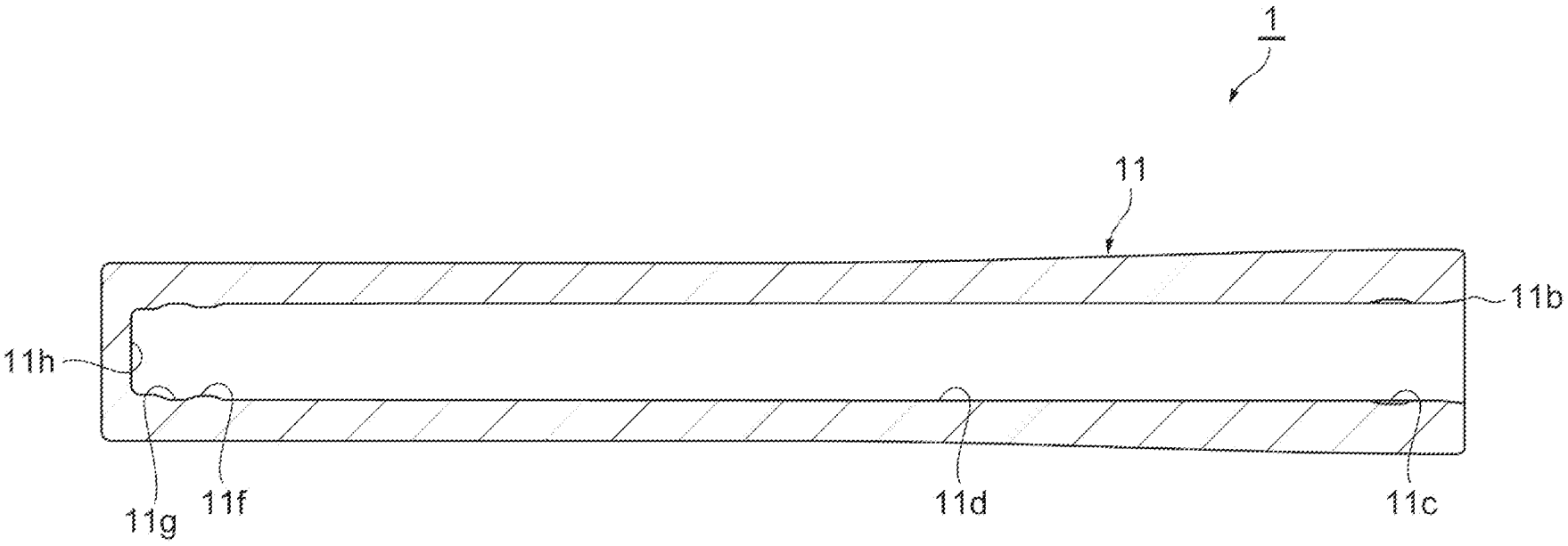
FIG. 9 is a sectional view of the cap illustrated in FIG. 8, taken along line C-C.

FIG. 8 is a side view illustrating the cap 1 (outer cap 11). FIG. 9 is a sectional view taken along line C-C in FIG. 8. As illustrated in FIGS. 8 and 9, the outer cap 11 has a bottomed cylindrical shape (or closed-ended cylindrical shape) having a bottom surface (or closed end) 11*h* located on the front side. The outer cap 11 has an opening 11*b*, a recess portion 11*c* with which the leading cylinder 4 inserted from an opening 11*b* engages, and a cylinder hole 11*d* into which the leading cylinder 4 is inserted. The cylinder hole 11*d* has a guide surface 11*x* (refer to FIGS. 15A, 15B or 15C) that guides the rotation of the leading cylinder 4. For example, the guide surfaces 11*x* are a pair of flattened surfaces (or substantially planar surfaces) aligned along the width direction of the outer cap 11. A function of the guide surface 11*x* will be described further below.

Furthermore, the outer cap 11 has an annular projection portion 11*f* projecting inward of the outer cap 11 on a bottom surface 11*h* side of the cylinder hole 11*d*, and an annular recess portion 11*g* located between the annular projection portion 11*f* and the bottom surface 11*h*. As illustrated in FIG. 3, the closing portion 12 engages with the annular projection portion 11*f* and the annular recess portion 11*g* in the axial direction, and a front end of the closing portion 12 comes into contact with the bottom surface 11*h*.

Figure 10A:
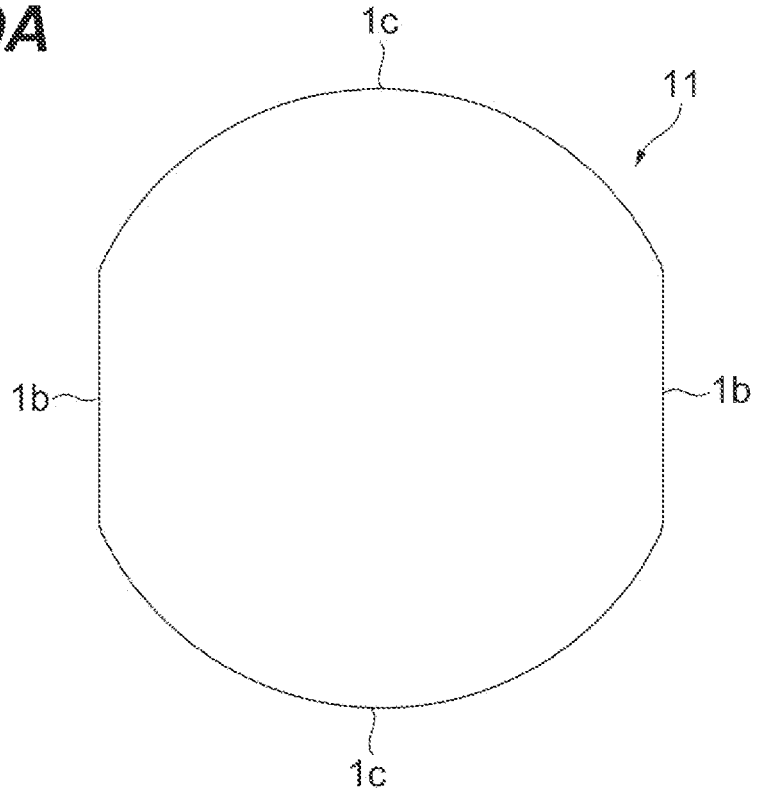
FIG. 10A is a front side view of the cap illustrated in FIG. 8.
Figure 10B:
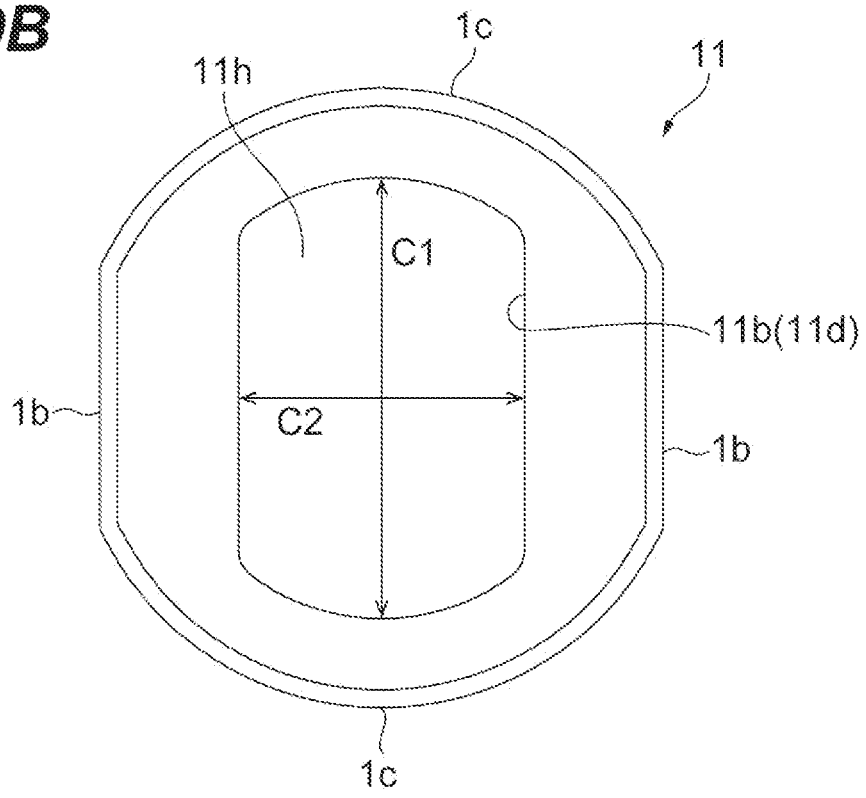
FIG. 10B is a rear side view of the cap illustrated in FIG. 8.

FIG. 10A is a front plan view of the outer cap 11 when the outer cap 11 is viewed from the front end of the outer cap 11. FIG. 10B is a rear plan view of the outer cap 11 when the outer cap 11 is viewed from the rear end of the outer cap 11. As illustrated in FIGS. 10A and 10B, the outer cap 11 has a pair of cap flattened surfaces (or substantially planar surfaces) 1*b* aligned along the width direction of the outer cap 11, and a pair of curved surfaces 1*c* for connecting end portions of the pair of cap flattened surfaces 1*b* to each other.

A cross section of the cap 1 (outer cap 11) taken along the plane orthogonal to the axial direction has an oblong shape (e.g., racetrack shape) including the cap flattened surface 1*b*. A cross section of the cylinder hole 11*d* in which the cap 1 (outer cap 11) is taken along the plane orthogonal to the axial direction has a flattened shape extending along a major axis C1 (second major axis) and a minor axis C2 (second minor axis). For example, the cross section of the cylinder hole 11*d* has an oblong shape (e.g., racetrack shape).

Figure 11:
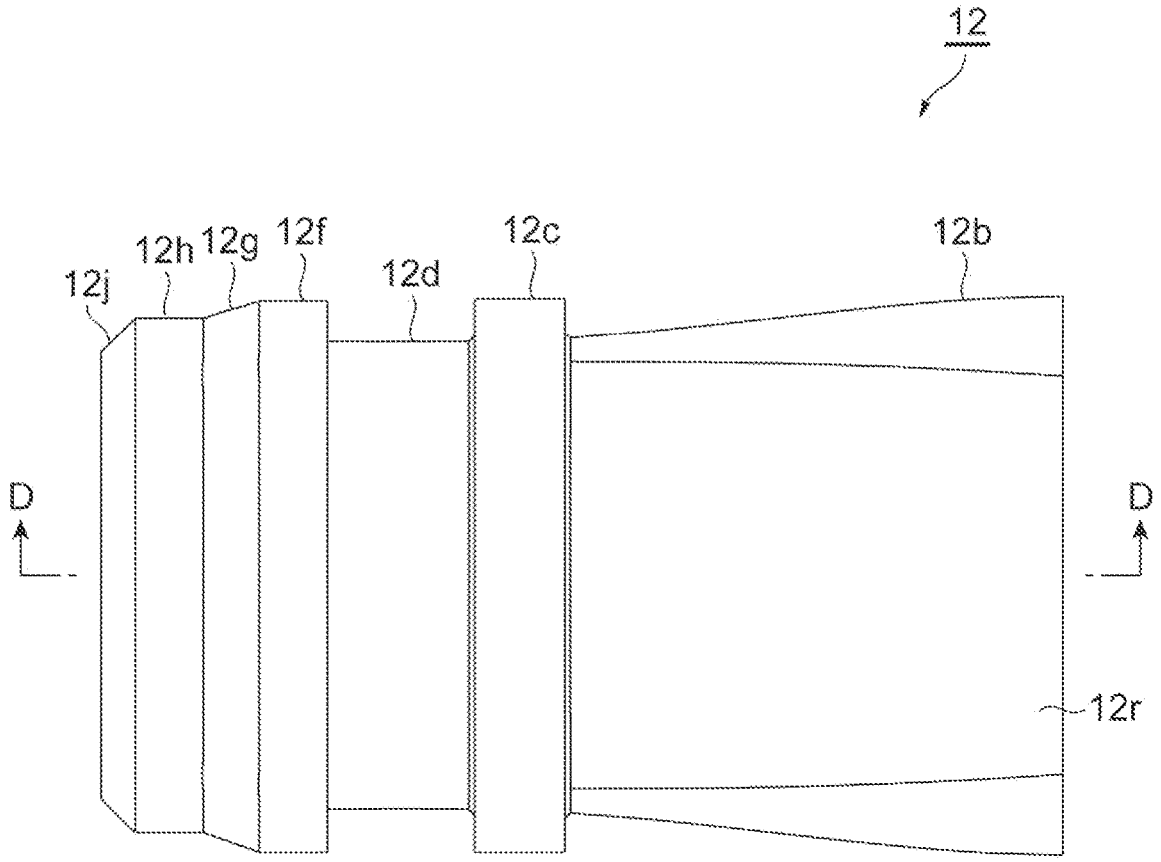
FIG. 11 is a side view of a closing portion of the cap illustrated in FIG. 8.
Figure 12:
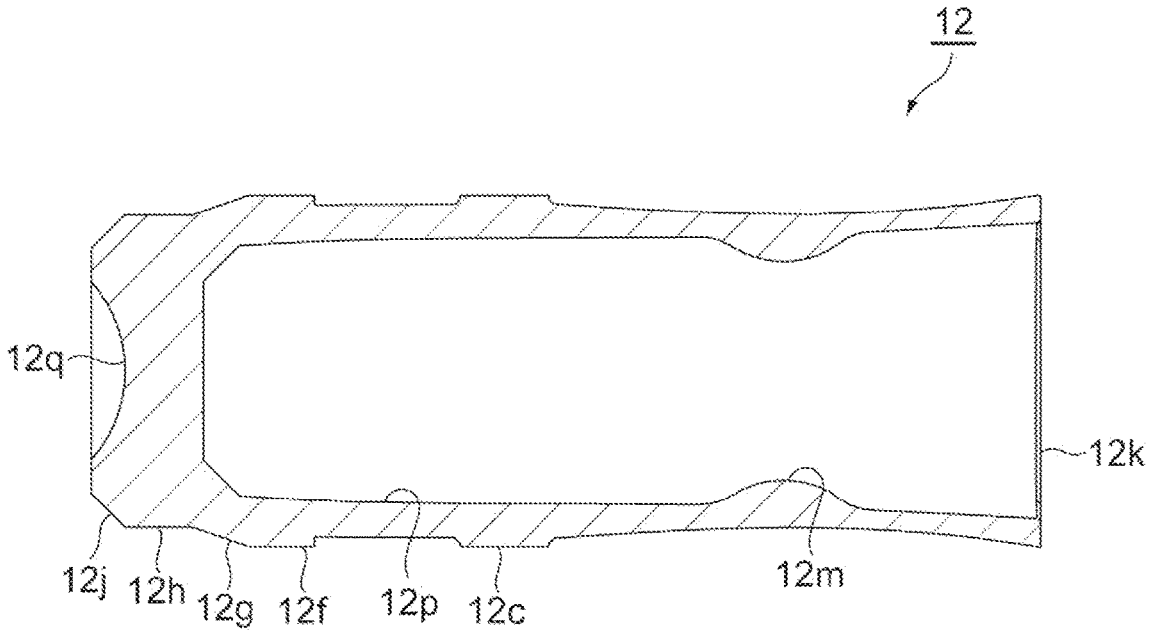
FIG. 12 is a sectional view of the closing portion illustrated in FIG. 11, taken along line D-D.

FIG. 11 is a side view illustrating the closing portion 12. FIG. 12 is a sectional view taken along line D-D in FIG. 11. As illustrated in FIGS. 11 and 12, the closing portion 12 has a substantially bottomed (closed-ended) cylindrical shape. The closing portion 12 has an opening 12*k*, an annular projection portion 12*m* coming into close contact with the tapered surface 4*c* of the leading cylinder front portion 4A inserted from the opening 12*k*, and a hole portion 12*p* into which the leading cylinder front portion 4A is inserted.

An outer periphery of the closing portion 12 includes an annular projection portion 12*c*, an annular projection portion 12*f* located on a front side of the annular projection portion 12*c* (e.g., the annular projection portion 12*f* is located toward the front, relative to the annular projection portion 12*c*), and a tapered surface 12*g* inclined so that a width (also referred to herein as a diameter) of the closing portion 12 decreases on a front side of the annular projection portion 12*f*. Furthermore, on a front side of the tapered surface 12*g*, the closing portion 12 has a front end side surface portion 12*h*, an inclined surface 12*j* inclined so that the diameter of the closing portion 12 decreases toward a front end of the front end side surface portion 12*h*, and a recess portion 12*q* that is recessed rearwardly and formed in a front end of the closing portion 12.

Figure 13:
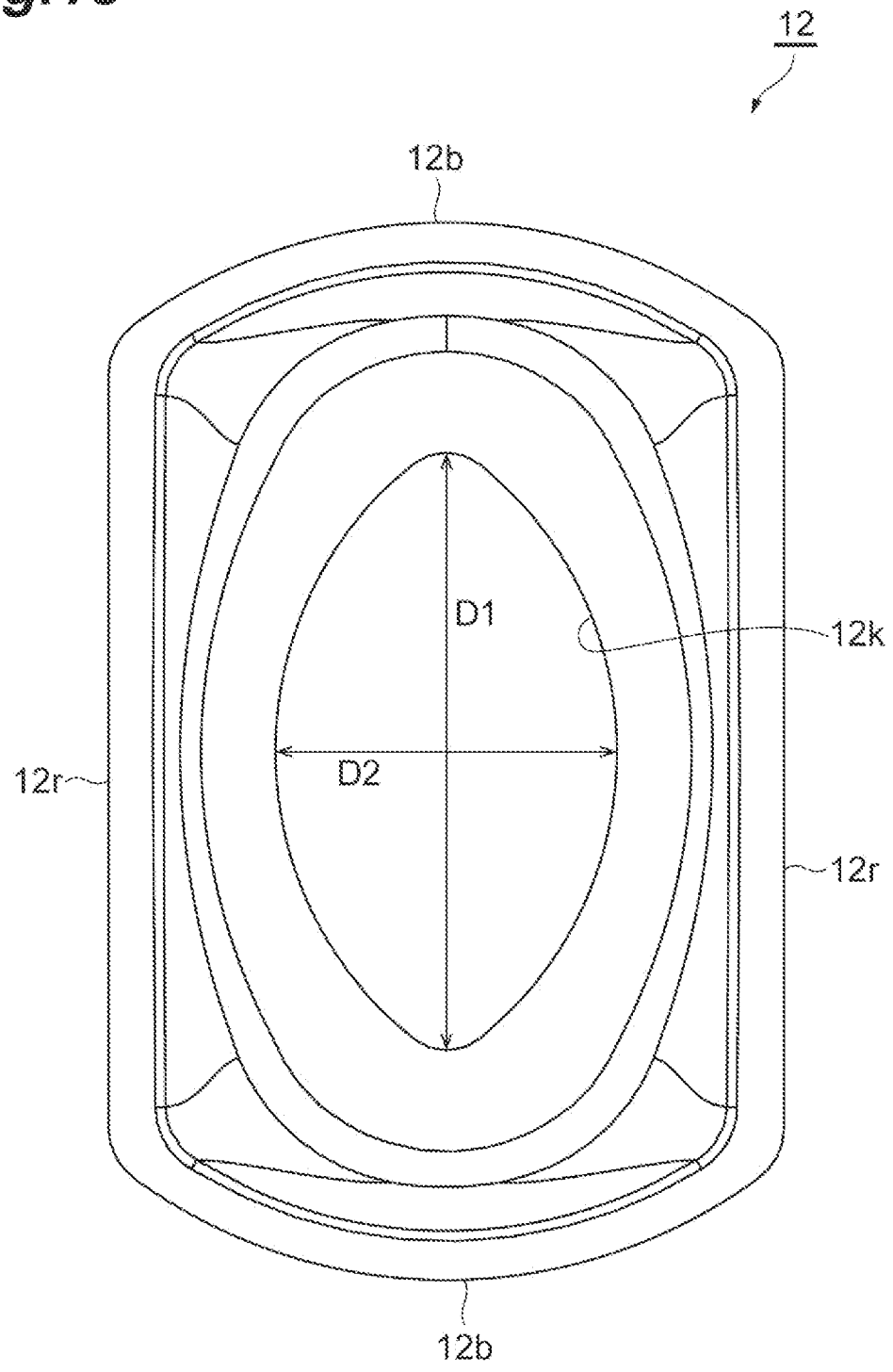
FIG. 13 is a rear side view of the closing portion of FIG. 12.

FIG. 13 is a rear plan view of the closing portion 12 viewed from the rear. For example, a shape of the closing portion 12 when viewed from the rear is an oblong shape having a pair of flat surfaces (or substantially planar surfaces) 12*r* connected by a pair of curved surfaces 12*b* (e.g., a racetrack shape).

A shape of the opening 12*k* when viewed from the rear end forms a flattened shape extending along a major axis D1 and a minor axis D2. As an example, the shape of the opening 12*k* is an elliptical shape. The opening 12*k* may have a shape similar to a shape of the leading cylinder front portion 4A when viewed from the front side. The respective dimensions of the opening 12*k* taken along the major axis D1 and the minor axis D2 may be substantially the same (approximately the same) as the respective dimensions (e.g., widths) of the leading cylinder front portion 4A taken along the major axis A1 and the minor axis A2, so as to further improve airtightness when the leading cylinder front portion 4A is inserted through the opening 12*k*.

As illustrated in FIG. 3, the annular projection portion 12*f* of the closing portion 12 is inserted into the annular recess portion 11*g* located on a front side of the annular projection portion 11*f* of the outer cap 11. In this way, the annular projection portion 12*f* fits into the annular recess portion 11*g*, thereby mounting the closing portion 12 on the inside of the outer cap 11. The leading cylinder front portion 4A of the leading cylinder 4 is inserted into the closing portion 12, and the annular projection portion 12*m* is brought into close contact with the tapered surface 4*c* of the leading cylinder front portion 4A, so as to increase the airtightness for the cosmetic material M located inside the opening 4*d*.

Referring to FIGS. 14, 15A, 15B, and 15C, the movement of the cap 1 and the leading cylinder 4 when the leading cylinder 4 is inserted into the cap 1 will be described. The closing portion 12 is mounted in advance inside the outer cap 11. In the example cosmetic material container 100, the cross section of the cap 1 (outer cap 11) and the leading cylinder 4 have a flattened shape rather than a circular shape. Therefore, as illustrated in FIG. 14, the leading cylinder 4 may be inserted into the cap 1 while aligning the rotational position of the leading cylinder 4 with respect to the cap 1 (for example, by aligning the flattened surface 4*x* of the leading cylinder rear portion 4B with the flattened surface 1*b* of the cap 1), to smoothly insert the leading cylinder 4 into the cap 1.

Figure 15A:
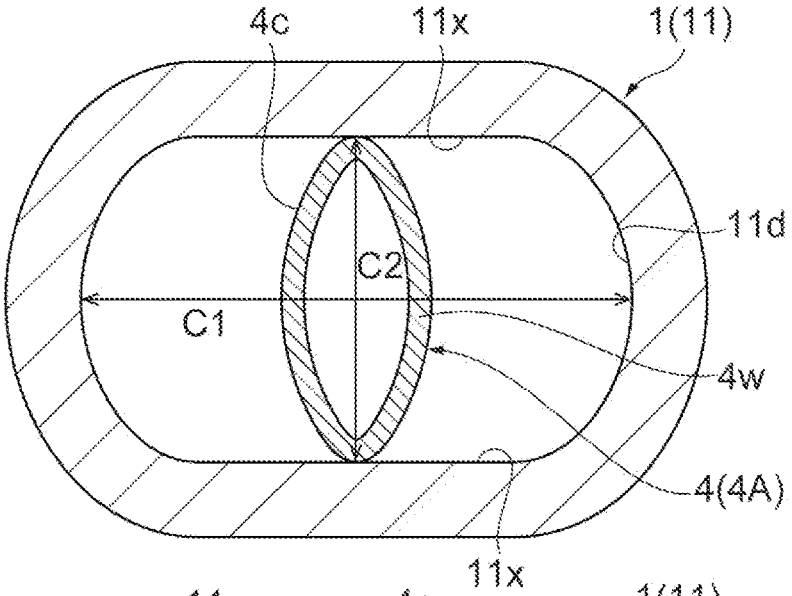
FIG. 15A is a sectional view of a leading cylinder and a cap, schematically illustrating a state in which a leading cylinder front portion of the leading cylinder is partially inserted into a cylinder hole of the cap.

Additionally, the leading cylinder 4 can also be smoothly inserted into the cap 1 without aligning the rotational position of the leading cylinder 4 with respect to the cap 1. An example operation in this case will be described. As illustrated in FIG. 15A, the leading cylinder front portion 4A is inserted into the opening 11*b* from the rear side in a state where the major axis A1 of the leading end portion 4*w* of the leading cylinder 4 intersects with (e.g., orthogonally to) the major axis C1 of the cylinder hole 11*d* and the minor axis A2 of the leading cylinder front portion 4A intersects with the minor axis C2 of the cylinder hole 11*d*.

Figure 15B:
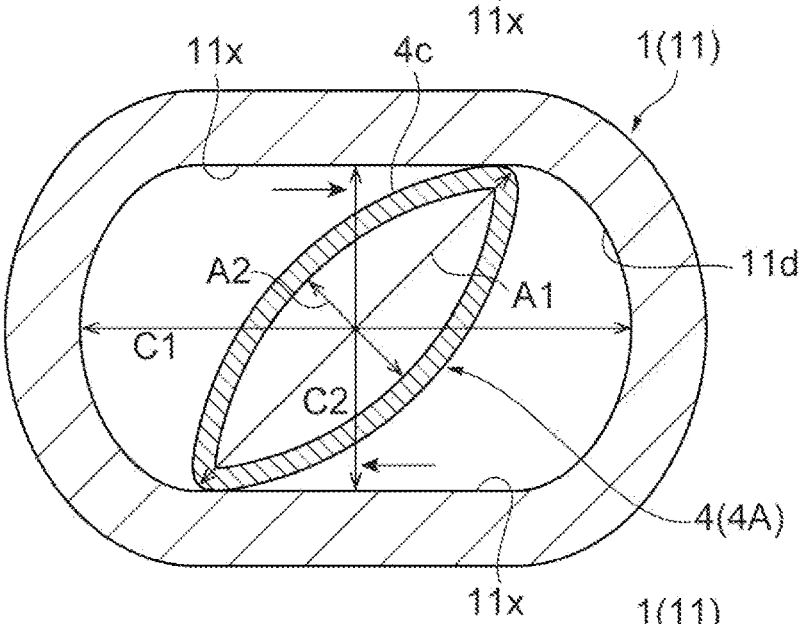
FIG. 15B is a sectional view of the leading cylinder and the cap illustrated in FIG. 15A, schematically illustrating a state in which the leading cylinder front portion is further inserted compared to the state illustrated in FIG. 15A.
Figure 15C:
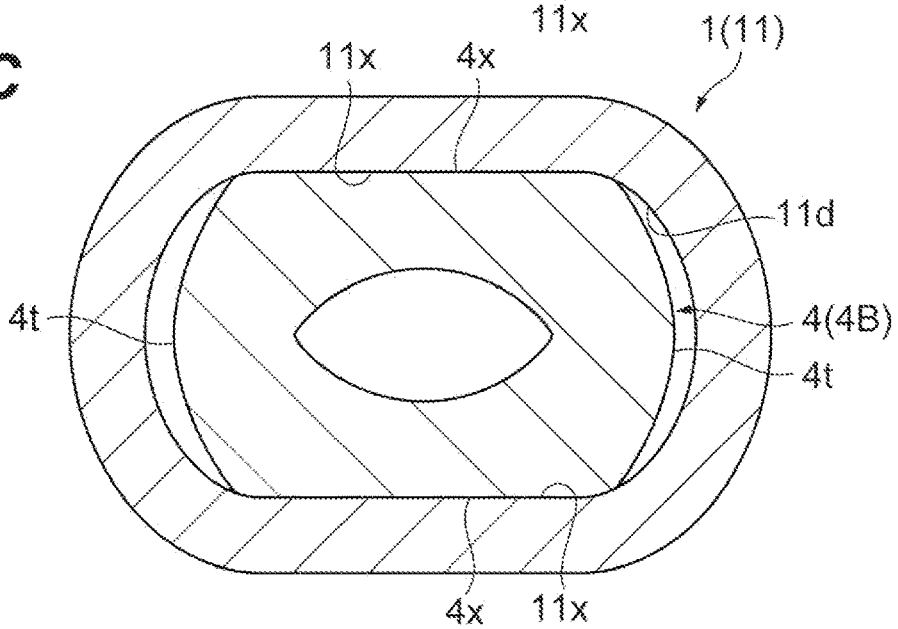
FIG. 15C is a sectional view of a leading cylinder and a cap, schematically illustrating a state in which a leading cylinder rear portion of the leading cylinder is inserted still further into the cylinder hole of the cap.

The width of the tapered surface 4*c* of the leading cylinder front portion 4A, taken in the major axis A1, increases rearwardly. Accordingly, when the leading cylinder front portion 4A is further inserted into the cylinder hole 11*d*, as illustrated in FIG. 15B, an end portion (e.g., end surface) in the direction of the major axis A1 of the leading cylinder front portion 4A, comes into sliding contact with the guide surface 11*x* of the cylinder hole 11*d* along the extending direction of the major axis C1. At this time, the end portion of the major axis A1 is in point contact with the guide surface 11*x*, for example.

In this way, the end portion of the major axis A1 of the leading cylinder front portion 4A comes into sliding contact with the guide surface 11*x*. Accordingly, the leading cylinder 4 is rotated with respect to the cap 1. When the leading cylinder front portion 4A is further inserted into the cylinder hole 11*d* as described above, the leading cylinder 4 is further rotated with respect to the cap 1. The guide surface 11*x* corrects the rotational position of the leading cylinder 4 with respect to the cap 1 so that the major axis A1 of the leading cylinder front portion 4A is aligned with the major axis C1 of the cylinder hole 11*d*.

The leading cylinder rear portion 4B of the leading cylinder 4 may be further inserted into the cap 1 when the rotational position with respect to the cap 1 is corrected. For example, when the leading cylinder rear portion 4B is inserted into the cap 1, the extending direction of the major axis A1 of the leading cylinder front portion 4A coincides with the extending direction of the major axis C1 of the cylinder hole 11*d*. In this state, the rotational position of the leading cylinder 4 with respect to the cap 1 is fixed, such that the leading cylinder 4 is rotationally fixed (e.g., not rotatable) with respect to the cap 1. When the leading cylinder rear portion 4B is inserted into the cap 1, the leading cylinder rear portion 4B moves forward in a state where the flattened surface 4*x* contacts (or abuts with) the guide surface 11*x* of the cylinder hole 11*d*.

Accordingly, the flattened surface 4*x* of the leading cylinder rear portion 4B functions as a contact surface (or an abutting surface) with respect to the guide surface 11*x*. The flattened surface 4*x* is in contact with the guide surface 11*x*, to improve the airtightness in the leading cylinder rear portion 4B. Subsequently, the engagement projection 4*r* of the leading cylinder rear portion 4B engages with the recess portion 11*c* of the cap 1, so as to mount the cap 1 onto the leading cylinder 4 completely.

Operational effects of the cosmetic material container 100 according to examples, will be described. In the cosmetic material container 100, as illustrated in FIGS. 3, 14, 15A, 15B and 15C, the leading cylinder 4 has the leading cylinder front portion 4A having the opening 4*d* through which the cosmetic material M appears. The cross section of the leading cylinder front portion 4A taken along the plane orthogonal to the axial direction L has the flattened shape extending along the major axis A1 and the minor axis A2. Accordingly, the cosmetic material M exposed from the opening 4*d* may be applied to an application target surface such as skin while the leading cylinder 4 is rotated, to selectively draw a thin line or a thick line, so as to improve ease of use.

The cap 1 of the cosmetic material container 100 includes mounted therein the closed-ended closing portion 12 that closes or covers the opening 4*d* of the leading cylinder 4. Accordingly, the opening 4*d* of the leading cylinder 4 can be closed by the closed-ended closing portion 12, to increase the airtightness for the cosmetic material M contained inside the leading cylinder 4. Additionally, the leading cylinder front portion 4A has the tapered surface 4*c* in which the width of the major axis A1 decreases toward the opening 4*d*, and the leading cylinder front portion 4A is in close contact with the inner surface of the closing portion 12, so as to further increase the airtightness for the cosmetic material M contained inside the leading cylinder 4.

Furthermore, the cap 1 includes the cylinder hole 11*d* having a cross section that forms the flattened shape extending along the major axis C1 and the minor axis C2. The cylinder hole 11*d* includes the guide surface 11*x* for rotating the leading cylinder 4 so that the extending direction of the major axis A1 of the leading cylinder front portion 4A coincides with the major axis C1, when the leading cylinder front portion 4A is inserted into the cap 1. Therefore, for any rotational position of the leading cylinder 4 having the flattened shape, with respect to the cap 1 having the flattened shape, when the leading cylinder front portion 4A is inserted into the cap 1, the guide surface 11*x* causes the leading cylinder 4 to rotate so that the major axis A1 associated with the leading cylinder 4 is aligned with the major axis C1 associated with the cylinder hole 11*d*. Accordingly, the cap 1 can be more easily mounted on the leading cylinder 4. For example, at any rotational position of the leading cylinder 4 having the flattened shape, with respect to the cap 1 having the flattened shape, when the leading cylinder 4 is inserted into the cap 1, the rotational position of the leading cylinder 4 is corrected by the guide surface 11*x*. Accordingly, the cap 1 can be more easily mounted on the leading cylinder 4 having the flattened shape.

In addition, the leading cylinder 4 includes the leading cylinder rear portion 4B located between the leading cylinder front portion 4A and the container body 2. The outer surface of the leading cylinder rear portion 4B includes the contact surface (for example, the flattened surface 4*x*) which comes into contact with the guide surface 11*x* of the cylinder hole 11*d*. In a state where the contact surface of the leading cylinder rear portion 4B is in contact with the guide surface 11*x* of the cylinder hole 11*d*, the rotation of the leading cylinder 4 with respect to the cap 1 may be restricted. In this case, when the leading cylinder rear portion 4B is inserted into the cylinder hole 11*d* of the cap 1, the contact surface of the leading cylinder rear portion 4B comes into contact with the guide surface 11*x* of the cylinder hole 11*d*. Accordingly, the rotation of the leading cylinder 4 with respect to the cap 1 is restricted, and the leading cylinder rear portion 4B can be inserted into the cylinder hole 11*d* along the axial direction L without being rotated, so as to more smoothly mount the cap 1 onto the leading cylinder 4.

In addition, the leading cylinder front portion 4A may have the leading end portion 4*w* in which the width along the major axis A1 is equal to or narrower than the width along the minor axis C2 of the cylinder hole 11*d*. Accordingly, the leading end portion 4*w* can be more easily inserted into the cylinder hole 11*d*. For example, for any rotational position of the leading end portion 4*w* of the leading cylinder 4 with respect to the cap 1, the leading end portion 4*w* can be inserted into the cylinder hole 11*d*, so as to more easily mount the cap 1 onto the leading cylinder 4.

In some examples, the leading cylinder front portion may have a leading end portion in which the width along the major axis is equal to or greater than the width along the minor axis C2 of the cylinder hole 11*d*. In this case, when the leading end portion is inserted into the cylinder hole 11*d*, the leading end portion may be inserted by positioning the major axis of the leading end portion obliquely with respect to the minor axis C2, and, the leading cylinder 4 can be more smoothly rotated with respect to the cap 1.

The cross section of the leading cylinder front portion 4A taken along the plane orthogonal to the axial direction L may have the elliptical shape. In this case, the leading cylinder front portion 4A can be formed into a smooth shape having no corner portion. Accordingly, the leading cylinder front portion 4A can be more smoothly rotated by the guide surface 11*x*, to more easily mount the cap 1 onto the leading cylinder 4.

The cross section of the cylinder hole lid of the cap 1, including the flattened surface as the guide surface 11*x*, taken along the plane orthogonal to the axial direction L may have the oblong shape, and the cross section of the leading cylinder rear portion 4B including the flattened surface 4*x* as the contact surface, taken along the plane orthogonal to the axial direction L, may have the oblong shape. Accordingly, the rotation of the leading cylinder 4 is restricted in a state where the flattened surface 4*x* of the leading cylinder rear portion 4B is in contact with the flattened guide surface 11*x* of the cylinder hole 11*d*, so as to more smoothly insert the leading cylinder rear portion 4B into the cylinder hole 11*d*.

The cross section of the cap 1 including the cap flattened surface 1*b*, taken along the plane orthogonal to the axial direction L may have the oblong shape. The cross section of the container body 2 including the container body flattened surface 2*b*, taken along the plane orthogonal to the axial direction L may have the oblong shape. The cap flattened surface 1*b* may be continuous with the container body flattened surface 2*b* along the axial direction L. Accordingly, a user can more easily recognize the rotationally position of the cap 1 with respect to the container body 2. For example, the user can more easily recognize that the cap 1 may be mounted so that the cap flattened surface 1*b* is aligned with the container body flattened surface 2*b*. Consequently, the cap 1 can be more easily mounted onto the container body 2, so as to improve ease of use of the cosmetic material container 100.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, the type, shape, size, number, material, and arrangement of each component of the cosmetic material container can be appropriately changed without changing the above-mentioned gist.

For example, although in the above-described examples, the cap 1 engages with the leading cylinder 4, in some examples, the cap may engage with the container body. Additionally, a counterpart component with which the cap engages is not particularly limited. In the above-described examples, the outer cap 11 and the closing portion 12 are separate from each other in the cap 1. In some examples, the outer cap and the closing portion may be integrated with each other, and the configuration of the cap can be suitably changed. In addition, although an example has been described in which the cross section of the cylinder hole 11*d* of the cap 1 taken along the plane orthogonal to the axial direction L has the oblong shape (racetrack shape), the cross section of the cylinder hole may have an elliptical shape, a diamond shape, a rectangular shape, a hexagonal shape, or an octagonal shape, and the shape can be suitably changed. In addition, although the cosmetic material container 100 including the leading cylinder 4 and the container body 2 that engages with the leading cylinder 4 in the axial direction L has been described, in which the leading cylinder 4 and the container body 2 are separate from each other, in some examples, the cosmetic material container may be configured so that the leading cylinder and the container body are integrated with each other (e.g., integrally formed together).

In addition, although an example has been described in which the cross section of the leading cylinder front portion 4A has the elliptical shape and the cross section of the leading cylinder rear portion 4B has the oblong shape (racetrack shape), in some examples, the cross section of the leading cylinder front portion and the leading cylinder rear portion may have an elliptical shape, a diamond shape, a rectangular shape, a hexagonal shape, or an octagonal shape, and the shape can be suitably changed. The same may apply to the cross-sectional shape of the container body. In addition, as for the container body 2, the cross-sectional shape of the operation cylinder may be the oblong shape delimited by a flattened surface, and the cross-sectional shape of the operation cylinder can be suitably changed.

What is claimed is:

1. A cosmetic material container comprising:

a container body extending in an axial direction;

a leading cylinder extending from the container body in the axial direction, wherein the leading cylinder includes a leading cylinder front portion that forms an opening to expose a cosmetic material, wherein a cross section of the leading cylinder front portion taken orthogonally to the axial direction has a flattened shape that extends in a first major axis and in a first minor axis, and wherein the leading cylinder front portion has a width in the first major axis that decreases in the axial direction toward the opening to form a tapered surface of the leading cylinder front portion; and a cap forming a hole to receive the leading cylinder, wherein the cap includes within the hole, a closed-ended closing portion to cover the opening of the leading cylinder, wherein the closed-ended closing portion has an inner surface to contact the leading cylinder front portion, wherein a cross section of the hole taken orthogonally to the axial direction has a flattened shape extending in a second major axis and in a second minor axis, and wherein the hole includes a guide surface to guide the leading cylinder into rotation when the leading cylinder front portion is inserted into the hole, so that the first major axis associated with leading cylinder front portion coincides with the second major axis associated with the hole of the cap.

2. The cosmetic material container according to claim 1, wherein the leading cylinder has a leading cylinder rear portion located between the leading cylinder front portion and the container body, wherein the leading cylinder rear portion includes an outer surface forming a contact surface to contact the guide surface of the hole of the cap, and wherein the contact surface is shaped to rotationally fix the leading cylinder with respect to the cap when the contact surface of the leading cylinder rear portion is in contact with the guide surface of the hole of the cap.

3. The cosmetic material container according to claim 2, wherein the cross section of the hole of the cap, defined by the guide surface of the hole, has a substantially oblong shape, and wherein the cross section of the leading cylinder rear portion, defined by the contact surface of the leading cylinder rear portion, has a substantially oblong shape.

4. The cosmetic material container according to claim 1, wherein the leading cylinder front portion forms a leading end portion having a width taken along the first major axis of the leading cylinder front portion that is equal to or less than a width of the hole of the cap, taken along the second minor axis of the hole.

5. The cosmetic material container according to claim 1, wherein the cross section of the leading cylinder front portion has an elliptical shape wherein a first dimension of the elliptical shape taken in the first major axis is greater than a second dimension of the elliptical shape taken in the first minor axis.

6. The cosmetic material container according to claim 1, wherein an outer surface of the cap includes a substantially planar surface that extends in the axial direction and wherein a cross section of the cap taken orthogonally to the axial direction has a substantially oblong shape, wherein an outer surface of the container body includes a substantially planar surface that extends in the axial direction and wherein a cross section of the container body taken orthogonally to the axial direction has a substantially oblong shape, and wherein the substantially planar surface of the cap is continuous with the substantially planar surface of the container body along the axial direction.

* * * * *